US007617828B1

(12) United States Patent
Sinha

(10) Patent No.: US 7,617,828 B1
(45) Date of Patent: Nov. 17, 2009

(54) TOILETRIES TRAVEL KIT

(76) Inventor: Navin K. Sinha, 635 Prairie Center Dr. Apt. 465, Eden Prairie, MN (US) 55344-5362

( * ) Notice: Subject to any disclaimer, the term of this patent is extended or adjusted under 35 U.S.C. 154(b) by 341 days.

(21) Appl. No.: 11/697,159

(22) Filed: Apr. 5, 2007

(51) Int. Cl.
*A45D 27/22* (2006.01)
*A45D 27/16* (2006.01)
*A45D 27/18* (2006.01)

(52) U.S. Cl. ..... 132/286; 132/290

(58) Field of Classification Search ..... 132/308–312; 34/41, 40; 206/581
See application file for complete search history.

(56) References Cited

U.S. PATENT DOCUMENTS 1,698,206 A * 1/1929 Tipton ..... 30/47
1,796,001 A * 3/1931 Church ..... 15/167.1
2,418,344 A * 4/1947 Goldberg ..... 15/187
4,760,642 A 8/1988 Kwak
5,040,553 A 8/1991 Londono et al.
5,599,126 A 2/1997 Hough
5,622,195 A * 4/1997 Lee ..... 132/289
5,706,545 A 1/1998 Yamada
5,850,659 A * 12/1998 Butler et al. ..... 15/167.1
6,000,410 A * 12/1999 Tortorice ..... 132/308
D426,708 S 6/2000 Francis
6,129,474 A 10/2000 Mitchell et al.
6,182,321 B1 * 2/2001 Wu ..... 15/167.1

FOREIGN PATENT DOCUMENTS

FR 2639522 A1 * 6/1990

OTHER PUBLICATIONS

Title of Source: News Ad on Jan. 31, 2004 Product Name: Fresh & Go Toothbrush.
Title of Source: 2001 InteliHealth Catalog; Product Name: Brush Now.
Title of Source: 2003 Campmor Mail Order Catalog; Product Name: Pack-Lite Toothbrush.

* cited by examiner

*Primary Examiner*—Robyn Doan

(57) ABSTRACT

This patent discloses a toiletries travel kit having a toothbrush kit and a razor kit in a bag. The toothbrush kit may include a brush head connected to a cap by a neck and a handle removably attached to the cap, where the handle includes a tooth paste container. A steel support may extend through the neck to permit the neck to bend between an angle of at least 90-degrees and retain that angle within plus/minus five degrees. The razor kit may include a razor head connected to a cap by a neck and a handle removably attached to the cap, where the handle includes a shaving cream container. A steel support may extend through the razor kit neck to permit the razor kit neck to bend between an angle of at least 90-degrees and retain that angle within plus/minus five degrees.

18 Claims, 4 Drawing Sheets

TOILETRIES TRAVEL KIT

BACKGROUND

1. Field

The information disclosed in this patent relates to a toiletries travel kit that may include a toothbrush and a razor.

2. Background Information

Toiletries include items that may be used for personal hygiene or grooming, such as toothbrush and razor articles and toothpaste and shaving cream preparations. Typically, these items are used at least one a day. Often, they are stored in a household bathroom cabinet ready for use.

Travelers also need to use toiletries at least once a day. However, it often is troublesome for travelers to carry bulky toothbrushes, razors, toothpaste, and shaving cream. Often, these items are forgotten or left behind. Moreover, the articles themselves are difficult to use and do not account for the individual user's features or desires. Thus, there is a need for a toiletries travel kit that includes items that provide more convenience.

SUMMARY

This patent discloses a toiletries travel kit having a toothbrush kit and a razor kit in a bag. The toothbrush kit may include a brush head connected to a cap by a neck and a handle removably attached to the cap, where the handle includes a tooth paste container. A steel support may extend through the neck to permit the neck to bend between an angle of at least 90-degrees and retain that angle within plus/minus five degrees. The razor kit may include a razor head connected to a cap by a neck and a handle removably attached to the cap, where the handle includes a shaving cream container. A steel support may extend through the razor kit neck to permit the razor kit neck to bend between an angle of at least 90-degrees and retain that angle within plus/minus five degrees.

DETAILED DESCRIPTION

Figure 1:
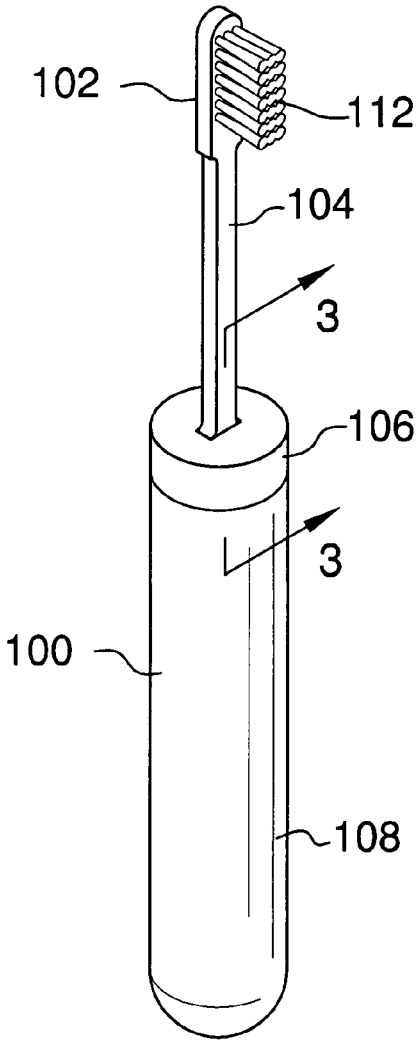
FIG. 1 is an isometric view of a toothbrush kit 100.
Figure 2:
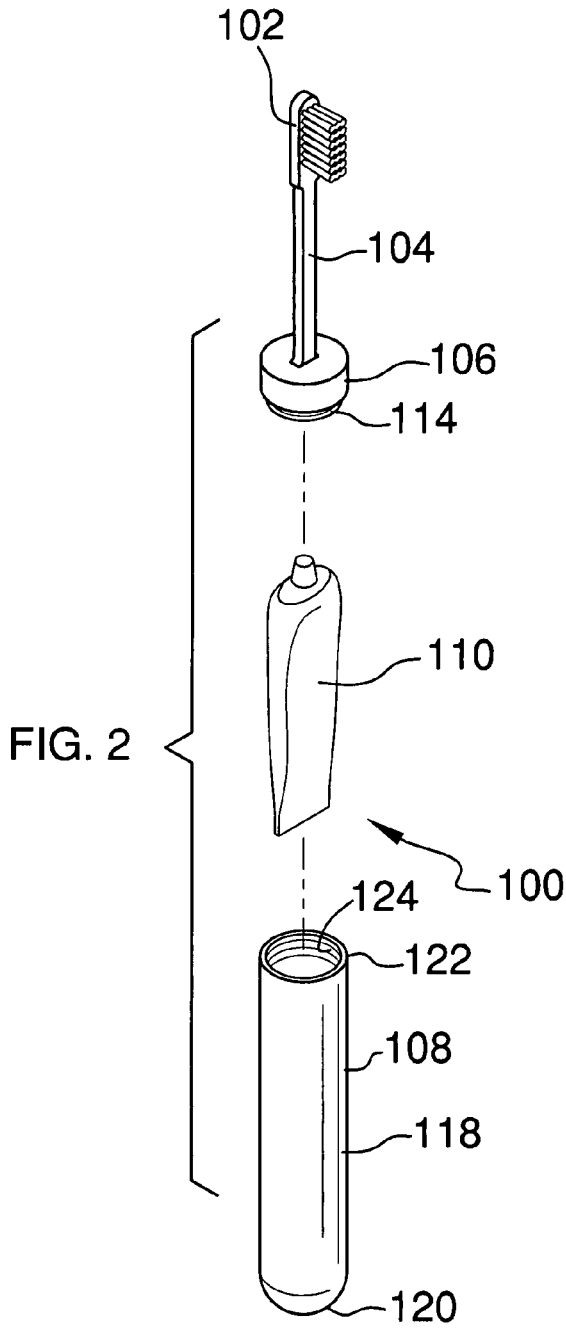
FIG. 2 is an exploded isometric view of toothbrush kit 100.

FIG. 1 is an isometric view of a toothbrush kit 100. FIG. 2 is an exploded isometric view of toothbrush kit 100. Toothbrush kit 100 may support the hygienic activity of a person brushing that person's teeth. Toothbrush kit 100 may include a brush head 102, a neck 104, a cap 106, a handle 108, and a tooth paste container 110.

Brush head 102 may be that portion of toothbrush kit 100 configured to enter a person's mouth. Brush head 102 may include bristles 112 and may be attached to neck 104. In one example, brush head 102 and neck 104 may be a solid piece of plastic.

Neck 104 may extend brush head 102 away from cap 106 to allow a person to reach their back teeth with brush head 102. Cap 106 may be a round top having cap threads 114 on one end and be connected to neck 104 on another end.

Handle 108 may be configured to fit comfortably within a person's hand. Handle 108 may include a cylinder 118 having a first end 120 that may be closed and a second end 122 that may be open. Second end 122 of handle 108 may include handle threads 124 that may be configured to mate with cap threads 114. In one example, handle 108 may be configured to glow in the dark where brush head 102 and neck 104 may not be configured to glow in the dark. This may have a benefit during manufacturing while still allowing toothbrush kit 100 to be viewed at night. In another example, handle 108 may be configured to glow at least one of fluorescent orange, pink, blue, and green.

Tooth paste container 110 may be a container having toothpaste and configured to fit within handle 108. In other words, handle 108 may be large enough in circumference to accommodate the storage of a supply of toothpaste or gel that may rest within an interior of handle 108.

In operation, brush head 102 may be removed from handle 108 to allow the stored paste or gel in tooth paste container 110 to be applied to bristles 112 of brush head. Next, handle 108 may be secured in place to cap 106.

Different people have different dental structure. In addition, some have large mouths and some have small mouths. To accommodate the different dental structures, it may be desirable to permit brush head 102 to bend at least 90 degrees for ease and thoroughness in brushing.

Figure 3:
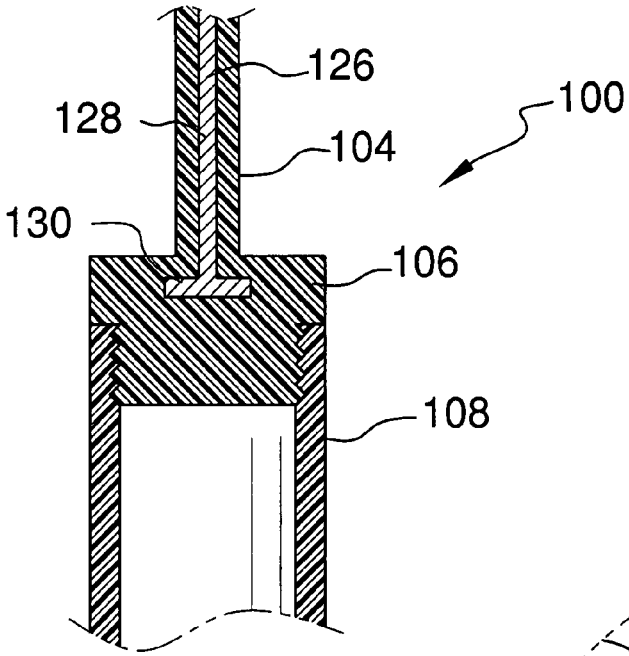
FIG. 3 is a section view of toothbrush kit 100 generally taken off of line 3-3 of FIG. 1.

FIG. 3 is a section view of toothbrush kit 100 generally taken off of line 3-3 of FIG. 1. Toothbrush kit 100 additionally may include a steel support 126. Steel support 126 may include an elongated portion 128 and a disk 130 attached at one end to the elongated portion 128. Elongated portion 128 may extend through a length of neck 104 and cap 106. In one example, elongated portion 128 may extend into brush head 102. Disk 130 may be a round plate positioned in cap 106.

Figure 4:
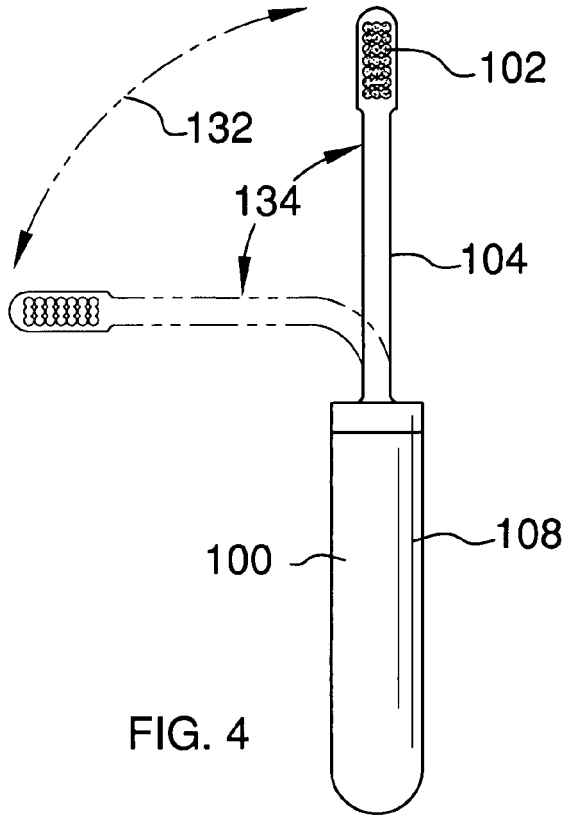
FIG. 4 is an elevated view of toothbrush kit 100 illustrating movement 132 of toothbrush kit 100.

FIG. 4 is an elevated view of toothbrush kit 100 illustrating movement 132 of toothbrush kit 100. Both neck 104 and steel support 126 (FIG. 3) together may be configured to bend between an angle 134 of at least 90-degrees and retain that angle within plus/minus five degrees. In this sense, neck 104 may be thought of as a flexible neck.

Figure 5:
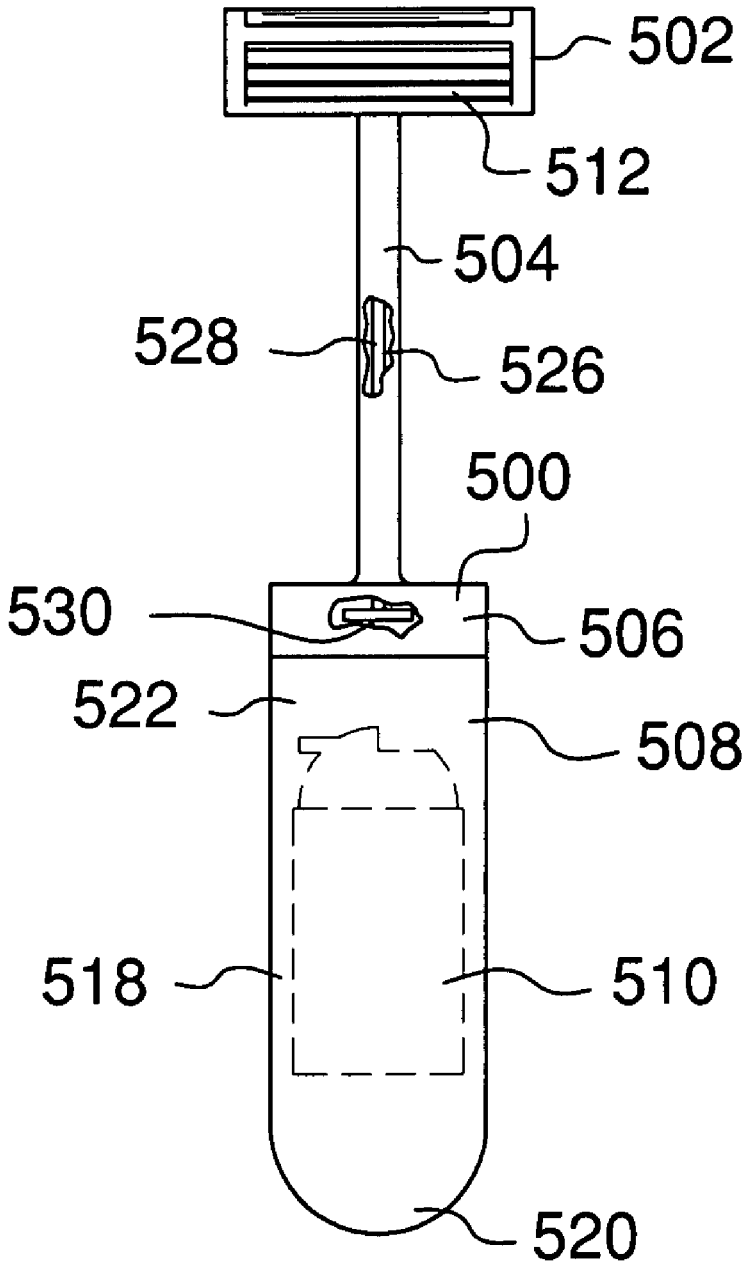
FIG. 5 is an elevated view of a razor kit 500.

FIG. 5 is an elevated view of a razor kit 500. Razor kit 500 may include a shaver head 502, a neck 504, a cap 506, a handle 508, and a shaving cream container 510.

Shaver head 502 may be that portion of razor kit 500 configured to interact with a person's face. Shaver head 502 may include blades 512 and may be attached to neck 504. In one example, shaver head 502 and neck 504 may be a solid piece of plastic.

Neck 504 may extend shaver head 502 away from cap 506 to minimize interference from a user's hand while shaving. Cap 506 may be a round top having cap threads 514 (hidden in view)) on one end and be connected to neck 504 on another end.

Handle 508 may be configured to fit comfortably within a person's hand. Handle 508 may include a cylinder 518 having a first end 520 that may be closed and a second end 522 that may be open. Second end 522 of handle 508 may include handle threads 524 (hidden in view) that may be configured to mate with cap threads 514. In one example, handle 508 may be configured to glow in the dark where shaver head 502 and neck 504 may not be configured to glow in the dark. This may have a benefit during manufacturing while still allowing razor kit 500 to be viewed at night. In another example, handle 508 may be configured to glow at least one of fluorescent orange, pink, blue, and green.

Shaving cream container 510 may be a container having shaving cream and configured to fit within handle 508. In other words, handle 508 may be large enough in circumference to accommodate the storage of a supply of shaving cream that may rest within an interior of handle 508.

In operation, shaver head 502 may be removed from handle 508 to allow the stored cream in shaving cream container 510 to be applied to blades 512 of shaver head. Next, handle 508 may be secured in place to cap 506.

Different people have different facial structure. To accommodate the different facial structures, it may be desirable to permit shaver head 502 to bend at least 90 degrees for ease and thoroughness in shaving. Razor kit 500 additionally may include a steel support 526. Steel support 526 may include an elongated portion 528 and a disk 530 attached at one end to the elongated portion 528. Elongated portion 528 may extend through a length of neck 504 and cap 506. In one example, elongated portion 528 may extend into shaver head 502. Disk 530 may be a round plate positioned in cap 506.

Figure 6:
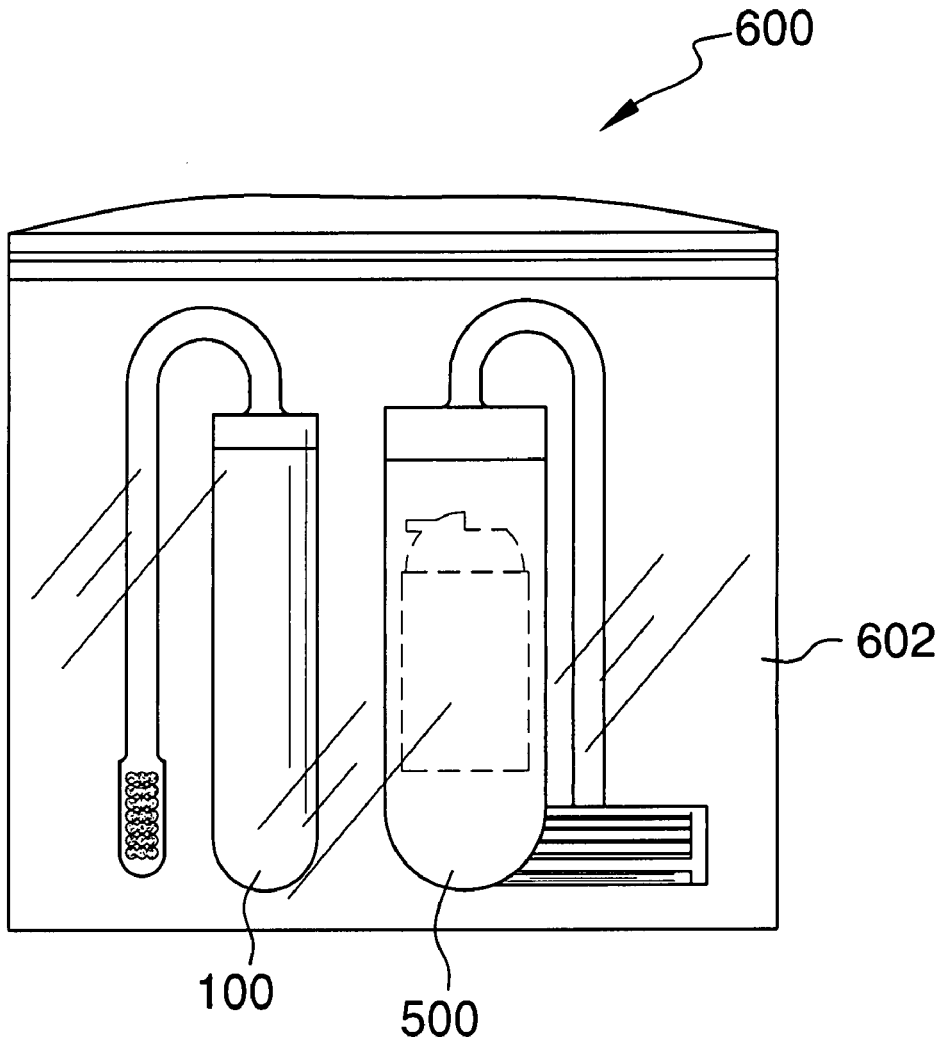
FIG. 6 is an elevated front view of a toiletries travel kit 600.

FIG. 6 is an elevated front view of a toiletries travel kit 600. Toiletries travel kit 600 may include toothbrush kit 100 and razor kit 500 in a bag 602. Each of toothbrush kit 100 and razor kit 500 may have their respective necks bent to at least 150-degrees to compact these items in as small of volume as possible.

The toiletries travel kit may include an oral care product that may combine a toothbrush together with toothpaste in one compact unit. While this oral care product may be of use to a wide array of individuals, it may be of particular appeal to travelers and members of the labor force, as well as college students. The toiletries travel kit may be produced in a wide array of sizes and colors appropriate for use by all.

The toiletries travel kit may fulfill a need for a more convenient device through which to brush one's teeth and shave one's face. The toiletries travel kit may eliminate the need to employ a toothbrush and separate tube of toothpaste and a razor separate from a shaving cream can. In addition, it may simplify the tooth brushing activity while in the home and when traveling or at work. Appealing features of the toiletries travel kit include its convenience, two-in-one design, portability, and compact size.

The toiletries travel kit may contain the toothbrush and toothpaste in one easy-to-transport unit. This may be used in the home or while traveling, working, or at school. The toiletries travel kit may eliminate the need to carry a full-sized toothbrush and tube of toothpaste separately. The use of the toiletries travel kit may reduce the mess commonly associated with using a separate tube of toothpaste including toothpaste landing upon every surface but the bristles of the brush head. In addition, the toiletries travel kit may eliminate mess associated with the cap coming off the tube of toothpaste while traveling. The toiletries travel kit may also provide the user with peace of mind that his breath was fresh and his teeth clean. In addition, the toiletries travel kit may reduce the chances of forgetting to pack oral hygiene products, and it may take up less space in a suitcase or overnight bag. This hygiene care product may be easily stored and transported.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A toiletries travel kit, comprising:

a bag;

a toothbrush kit positioned in the bag, where the toothbrush kit includes a brush head having bristles projecting away from the brush head, a toothbrush neck, a toothbrush cap having external toothbrush cap threads, a toothbrush handle comprised of a hollow toothbrush cylinder open only at one internally threaded toothbrush cylinder end, a toothpaste container having toothpaste therein that is prevented from leaving the toothpaste container by a toothpaste cap removeably screwed onto the toothpaste container, and a toothbrush steel support having a toothbrush elongated portion permanently attached to a center of a round toothbrush disk, where the brush head is attached to the toothbrush neck and the toothbrush neck is attached to the toothbrush cap, where the toothbrush handle is removeably screwed into the toothbrush cap, where the toothpaste container is in the toothbrush handle, where the toothbrush elongated portion extends through a length of the toothbrush neck and the toothbrush cap and the toothbrush disk is sealed inside the toothbrush cap, where both the toothbrush neck and the toothbrush steel support are flexible and nonresilient over their entire length and together are configured to bend in a direction that is perpendicular to the projection of the bristles of the brush head between an angle of zero degrees at least 90-degrees relative to the toothbrush handle and retain that angle within plus/minus five degrees, where the toothbrush cap, the toothbrush disk, and the toothbrush elongated portion prevents flow of toothpaste from the toothpaste container through the toothbrush neck to the brush head, and where the connected toothbrush handle and toothbrush cap completely enclose the toothpaste container so as to prevent forces external to the toothbrush handle and the toothbrush cap from engaging the toothpaste container; and a razor kit positioned in the bag, where the razor kit includes a shaver head, a razor neck, a razor cap having external razor cap threads, a razor handle comprised of a hollow razor cylinder open only at one internally threaded razor cylinder end, a shaving cream container having shaving cream therein, and a razor steel support having a razor elongated portion permanently attached to a center of a round razor disk, where the shaver head is attached to the razor neck and the razor neck is attached to the razor cap, where the razor handle is removably screwed into the razor cap, where the shaving cream container is in the razor handle, where the razor elongated portion extends through a length of the razor neck and the razor cap and the razor disk is sealed inside the razor cap, where both the razor neck and the razor steel support are flexible and nonresilient over their entire length and together are configured to bend between an angle of zero degrees and at least 90-degrees relative to the razor handle and retain that angle within plus/minus five degrees, where the razor cap, the razor disk, and the razor elongated portion prevent flow of shaving cream from the shaving cream container through the razor neck to the shaver head, and where the connected razor handle and razor cap completely enclose the toothpaste container so as to prevent forces external to the razor handle and the razor cap from engaging the shaving cream container, where each of the toothbrush kit and razor kit have their respective necks bent at least 150-degrees relative to their respective handle at a position adjacent to their respective cap, and where the razor kit is physically separate from the toothbrush kit and unrestricted within the bag from coming into contact with the toothbrush kit.

2. The toiletries travel kit of claim 1, where the toothbrush elongated portion extends into the brush head of the toothbrush kit.

3. The toiletries travel kit of claim 2, where the toothbrush handle is configured to glow in the dark and where the brush head and the toothbrush neck are not configured to glow in the dark.

4. The toiletries travel kit of claim 3, where the toothbrush handle is configured to glow at least one of fluorescent orange, pink, blue, and green.

5. The toiletries travel kit of claim 4, where the razor elongated portion extends into the shaver head of the razor kit.

6. The toiletries travel kit of claim 5, where the razor handle is configured to glow in the dark and where the shaver head and the razor neck are not configured to glow in the dark.

7. The toiletries travel kit of claim 6, where the razor handle is configured to glow at least one of fluorescent orange, pink, blue, and green, where the neck of each of the toothbrush kit and razor kit are configured to be bent and fixed in position to at least five difference angles relative to their respective handle over at least 150-degrees, and where the bag is resealable and made of a material through which the toothbrush kit and the razor kit are visible.

8. A method to use a toiletries travel kit, the method comprising:

presenting the toiletries travel kit comprising a bag, a toothbrush kit positioned in the bag, and a razor kit positioned in the bag, where the toothbrush kit includes a brush head having bristles projecting away from the brush head, a toothbrush neck, a toothbrush cap having external toothbrush cap threads, a toothbrush handle comprised of a hollow toothbrush cylinder open only at one internally threaded toothbrush cylinder end, a toothpaste container having toothpaste therein that is prevented from leaving the toothpaste container by a toothpaste cap removably screwed onto the toothpaste container, and a toothbrush steel support having a toothbrush elongated portion permanently attached to a center of a round toothbrush disk, where the brush head is attached to the toothbrush neck and the toothbrush neck is attached to the toothbrush cap, where the toothbrush handle is removably screwed into the toothbrush cap, where the toothpaste container is in the toothbrush handle, where the toothbrush elongated portion extends through a length of the toothbrush neck and the toothbrush cap and the toothbrush disk is sealed inside the toothbrush cap, where both the toothbrush neck and the toothbrush steel support are flexible and nonresilient over their entire length and together are configured to bend in a direction that is perpendicular to the projection of the bristles of the brush head between an angle of at least 90-degrees and retain that angle within plus/minus five degrees, where the toothbrush cap, the toothbrush disk, and the toothbrush elongated portion prevents flow of toothpaste from the toothpaste container through the toothbrush neck to the brush head, and where the connected toothbrush handle and toothbrush cap completely enclose the toothpaste container so as to prevent forces external to the toothbrush handle and the toothbrush cap from engaging the toothpaste container, where the razor kit includes a shaver head, a razor neck, a razor cap having external razor cap threads, a razor handle comprised of a hollow razor cylinder open only at one internally threaded razor cylinder end, a shaving cream container having shaving cream therein, and a razor steel support having a razor elongated portion permanently attached to a center of a round razor disk, where the shaver head is attached to the razor neck and the razor neck is attached to the razor cap, where the razor handle is removably screwed into the razor cap, where the shaving cream container is in the razor handle, where the razor elongated portion extends through a length of the razor neck and the razor cap and the razor disk is sealed inside the razor cap, where both the razor neck and the razor steel support are flexible and nonresilient over their entire length and together are configured to bend between an angle of at least 90-degrees and retain that angle within plus/minus five degrees, where the razor cap, the razor disk, and the razor elongated portion prevent flow of shaving cream from the shaving cream container through the razor neck to the shaver head, and where the connected razor handle and razor cap completely enclose the toothpaste container so as to prevent forces external to the razor handle and the razor cap from engaging the shaving cream container, where each of the toothbrush kit and razor kit have their respective necks bent at least 150-degrees relative to their respective handle at a position adjacent to their respective cap, and where the razor kit is physically separate from the toothbrush kit and unrestricted within the bag from coming into contact with the toothbrush kit; and removing the shaving cream container from the bag by lifting the razor kit without lifting the toothpaste kit.

9. The method of claim 8, further comprising:

unbending the razor neck from its position of at least 150-degrees to align the razor neck with the razor handle;

unscrewing the razor cap from the razor handle;

removing the shaving cream container from the razor handle;

dispensing shaving cream while the shaving cream container is positioned remote from the razor handle;

returning the shaving cream container into the razor handle; and screwing the razor cap from the razor handle.

10. The method of claim 9, further comprising:

bending the razor neck from its position align with the razor handle to an angle of at least 150-degrees relative to the razor handle; and adding the razor kit into the bag.

11. The method of claim 10, further comprising:

removing the toothpaste container from the bag by lifting the toothpaste kit without lifting the razor kit;

unbending the toothbrush neck from its position of at least 150-degrees to align the toothbrush neck with the toothbrush handle;

unscrewing the toothbrush cap from the toothbrush handle;

removing the toothpaste container from the toothbrush handle; and dispensing toothpaste while the toothpaste container is positioned remote from the toothbrush handle.

12. A toiletries travel kit, comprising:

a bag;

a toothbrush kit positioned in the bag, where the toothbrush kit includes a brush head having bristles projecting away from the brush head, a toothbrush neck, a toothbrush cap having external toothbrush cap threads, a toothbrush handle comprised of a hollow toothbrush cylinder open only at one internally threaded toothbrush cylinder end, a toothpaste container having toothpaste therein, and a toothbrush steel support having a toothbrush elongated portion permanently attached to a center of a round toothbrush disk, where the brush head is attached to the toothbrush neck and the toothbrush neck is attached to the toothbrush cap, where the toothbrush handle is removeably screwed into the toothbrush cap, where the toothpaste container is in the toothbrush handle, where the toothbrush elongated portion extends through a length of the toothbrush neck and the toothbrush cap and the toothbrush disk is sealed inside the toothbrush cap, where both the toothbrush neck and the toothbrush steel support are flexible and nonresilient over their entire length and together are configured to bend in a direction that is perpendicular to the projection of the bristles of the brush head between an angle of zero degrees at least 90-degrees relative to the toothbrush handle and retain that angle within plus/minus five degrees, and where the toothbrush cap, the toothbrush disk, and the toothbrush elongated portion prevents flow of toothpaste from the toothpaste container through the toothbrush neck to the brush head; and a razor kit positioned in the bag, where the razor kit includes a shaver head, a razor neck, a razor cap having external razor cap threads, a razor handle comprised of a hollow razor cylinder open only at one internally threaded razor cylinder end, a shaving cream container having shaving cream therein, and a razor steel support having a razor elongated portion permanently attached to a center of a round razor disk, where the shaver head is attached to the razor neck and the razor neck is attached to the razor cap, where the razor handle is removeably screwed into the razor cap, where the shaving cream container is in the razor handle, where the razor elongated portion extends through a length of the razor neck and the razor cap and the razor disk is sealed inside the razor cap, where both the razor neck and the razor steel support are flexible and nonresilient over their entire length and together are configured to bend between an angle of zero degrees and at least 90-degrees relative to the razor handle and retain that angle within plus/minus five degrees, and where the razor cap, the razor disk, and the razor elongated portion prevent flow of shaving cream from the shaving cream container through the razor neck to the shaver head, where each of the toothbrush kit and razor kit have their respective necks bent at least 150-degrees relative to their respective handle at a position adjacent to their respective cap, and where the razor kit is physically separate from the toothbrush kit and unrestricted within the bag from coming into contact with the toothbrush kit.

13. The toiletries travel kit of claim 12, where the toothbrush elongated portion extends into the brush head of the toothbrush kit, where the toothpaste is prevented from leaving the toothpaste container by a toothpaste cap removably screwed onto the toothpaste container, where the connected toothbrush handle and toothbrush cap completely enclose the toothpaste container so as to prevent forces external to the toothbrush handle and the toothbrush cap from engaging the toothpaste container, and where the connected razor handle and razor cap completely enclose the toothpaste container so as to prevent forces external to the razor handle and the razor cap from engaging the shaving cream container.

14. The toiletries travel kit of claim 13, where the toothbrush handle is configured to glow in the dark and where the brush head and the toothbrush neck are not configured to glow in the dark.

15. The toiletries travel kit of claim 14, where the toothbrush handle is configured to glow at least one of fluorescent orange, pink, blue, and green.

16. The toiletries travel kit of claim 15, where the razor elongated portion extends into the shaver head of the razor kit.

17. The toiletries travel kit of claim 16, where the razor handle is configured to glow in the dark and where the shaver head and the razor neck are not configured to glow in the dark.

18. The toiletries travel kit of claim 17, where the razor handle is configured to glow at least one of fluorescent orange, pink, blue, and green, where the neck of each of the toothbrush kit and razor kit are configured to be bent and fixed in position to at least five difference angles relative to their respective handle over at least 150-degrees, and where the bag is re-sealable and made of a material through which the toothbrush kit and the razor kit are visible.

* * * * *